US008268223B2

(12) United States Patent
Manthei

(10) Patent No.: US 8,268,223 B2
(45) Date of Patent: Sep. 18, 2012

(54) FORM AND PROCESS FOR CASTING CONCRETE BLOCKS

(75) Inventor: Benjamin R. Manthei, Petoskey, MI (US)

(73) Assignee: Redi-Rock International, LLC, Charlevoix, MI (US)

( * ) Notice: Subject to any disclaimer, the term of this patent is extended or adjusted under 35 U.S.C. 154(b) by 173 days.

(21) Appl. No.: 12/697,033

(22) Filed: Jan. 29, 2010

(65) Prior Publication Data

US 2010/0193995 A1 Aug. 5, 2010

Related U.S. Application Data

(60) Provisional application No. 61/148,442, filed on Jan. 30, 2009.

(51) Int. Cl.
*B28B 7/20* (2006.01)

(52) U.S. Cl. ..... 264/333; 264/293; 264/297.9; 264/336; 249/151; 249/152; 249/155; 249/158; 249/162

(58) Field of Classification Search ..... 264/293, 264/297.9, 333, 336; 249/151, 152, 155, 249/158, 162
See application file for complete search history.

(56) References Cited

U.S. PATENT DOCUMENTS

| | | | | |
|---|---|---|---|---|
| 788,481 | A * | 4/1905 | Lightner | 249/140 |
| 1,060,188 | A * | 4/1913 | Jacobson | 249/162 |
| 3,694,128 | A | 9/1972 | Foxen | |
| 3,918,877 | A | 11/1975 | Pickett | |
| 4,389,036 | A | 6/1983 | Abou-Ezzeddine | |
| 4,869,660 | A | 9/1989 | Ruckstuhl | |
| 5,055,252 | A * | 10/1991 | Zimmerman | 264/263 |
| 5,248,466 | A * | 9/1993 | Russell, III | 264/72 |
| 5,397,228 | A | 3/1995 | Metten | |
| 2001/0026734 | A1 * | 10/2001 | Manthei | 405/284 |
| 2003/0067096 | A1 | 4/2003 | Jurik | |
| 2004/0007227 | A1 | 1/2004 | Pedersen et al. | |
| 2004/0227053 | A1 | 11/2004 | Manthei | |
| 2005/0121830 | A1 | 6/2005 | Ness et al. | |
| 2006/0249881 | A1 | 11/2006 | Castonguay et al. | |
| 2007/0272823 | A1 | 11/2007 | Steffen | |
| 2008/0157430 | A1 | 7/2008 | Davies et al. | |
| 2008/0258340 | A1 | 10/2008 | Klettenberg | |

FOREIGN PATENT DOCUMENTS

CA 2463194 A1 10/2004

* cited by examiner

*Primary Examiner* — Christina Johnson
*Assistant Examiner* — Saeed Huda
(74) *Attorney, Agent, or Firm* — MacMillan, Sobanski & Todd, LLC

(57) ABSTRACT

A form and process for casting concrete blocks, each having at least one side textured. The blocks are cast in cavities which have a resilient insert on at least one side for imparting texture to the blocks. After the cast blocks are cured, the form is inverted and placed on a support surface. At least the side having the resilient insert is moved laterally away from the block and the form is lifted to leave the block on the support surface. The textured side can release from the form despite deep grooves and crevices simulating natural stones.

4 Claims, 4 Drawing Sheets

FORM AND PROCESS FOR CASTING CONCRETE BLOCKS

CROSS-REFERENCE TO RELATED APPLICATIONS

Applicant claims priority to U.S. Provisional Patent Application Ser. No. 61/148,442 filed Jan. 30, 2009.

STATEMENT REGARDING FEDERALLY SPONSORED RESEARCH OR DEVELOPMENT

Not Applicable.

TECHNICAL FIELD

The invention relates to a form and a process for casting concrete blocks, and more specifically to a form which can be used to cast concrete blocks with deep texture on one side or on opposite sides of the block. The form also may be used to cast concrete blocks having one or more vertical passages through the block. Further, the form may be designed for casting a single block or for simultaneously casting multiple blocks.

BRIEF SUMMARY OF THE INVENTION

The invention is directed to a form and a process for casting one or more concrete blocks each of which has either one side of the block textured or two opposite sides of the block textured. The form defines one or more cavities, each having a bottom and sides including the textured side or sides and an open top in which concrete is poured to cast the block. After the blocks have sufficiently cured, the form is then engaged with a machine which inverts the form and positions it above a support surface such as a pallet. The sides of the form which define the textured sides of the block or blocks are then moved apart by the machine to provide clearance for the block or blocks to release from the form and the form is lifted away from the support surface, leaving the finished blocks. The machine may be, for example, a forklift which has tines which engage slots in the form. The sides of the form are moved apart by increasing the spacing of the forklift tines. Alternately, a dedicated machine may be provided for inverting and positioning the form above the support surface, separating the form sides, lifting the form, returning the form back to an upright position for casting additional blocks. The form may include one or more members which form vertical passages and end grooves in the cast blocks. These members have sufficient relief to allow the blocks to easily release from the inverted form.

Various objects and advantages of the invention will become apparent from the following detailed description of the invention and the accompanying drawings.

DETAILED DESCRIPTION OF THE INVENTION

Figure 1:
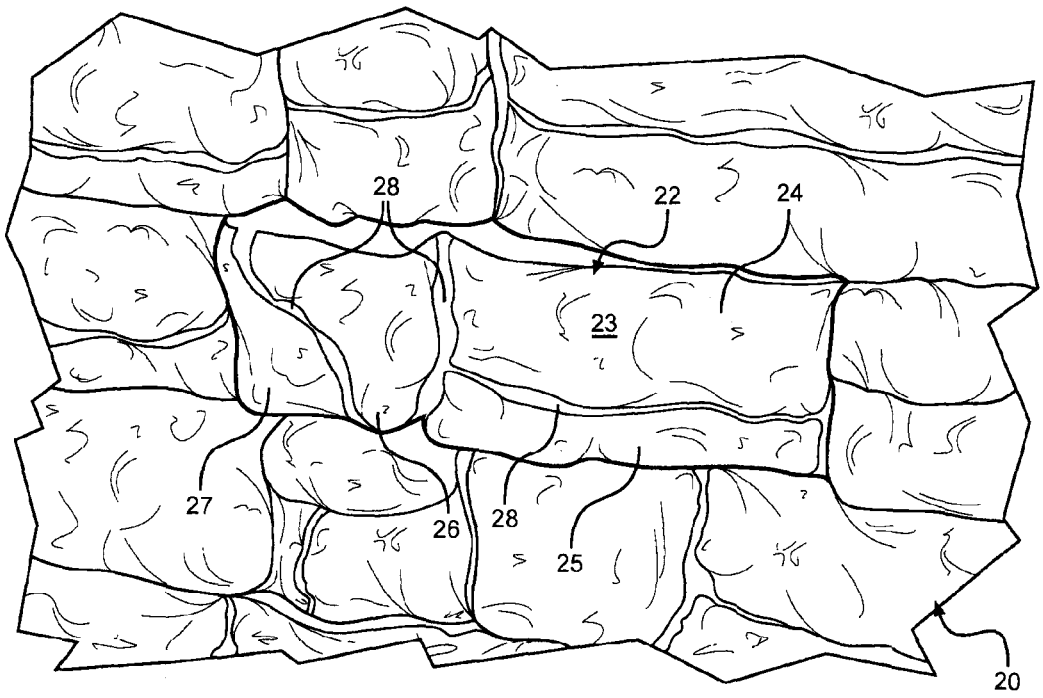
FIG. 1 is a fragmentary perspective view of an exemplary section of a retaining which constructed from concrete blocks cast in the form of the present invention and according to the process of the present invention.

FIG. 1 is a perspective view of a fragmentary portion of a retaining wall 20 formed from a plurality of stacked blocks which are cast with highly textured faces 21 which simulate natural stones. A single block 22 may have a face 23 which simulates multiple stones, in this case four simulated stones 24-27 with deep grooves 28 between adjacent simulated stones 24-27. If the wall 20 is a freestanding wall, opposite faces of the blocks may be textured so that both sides of the wall 20 will appear to be formed from stacked stones.

Figure 2:
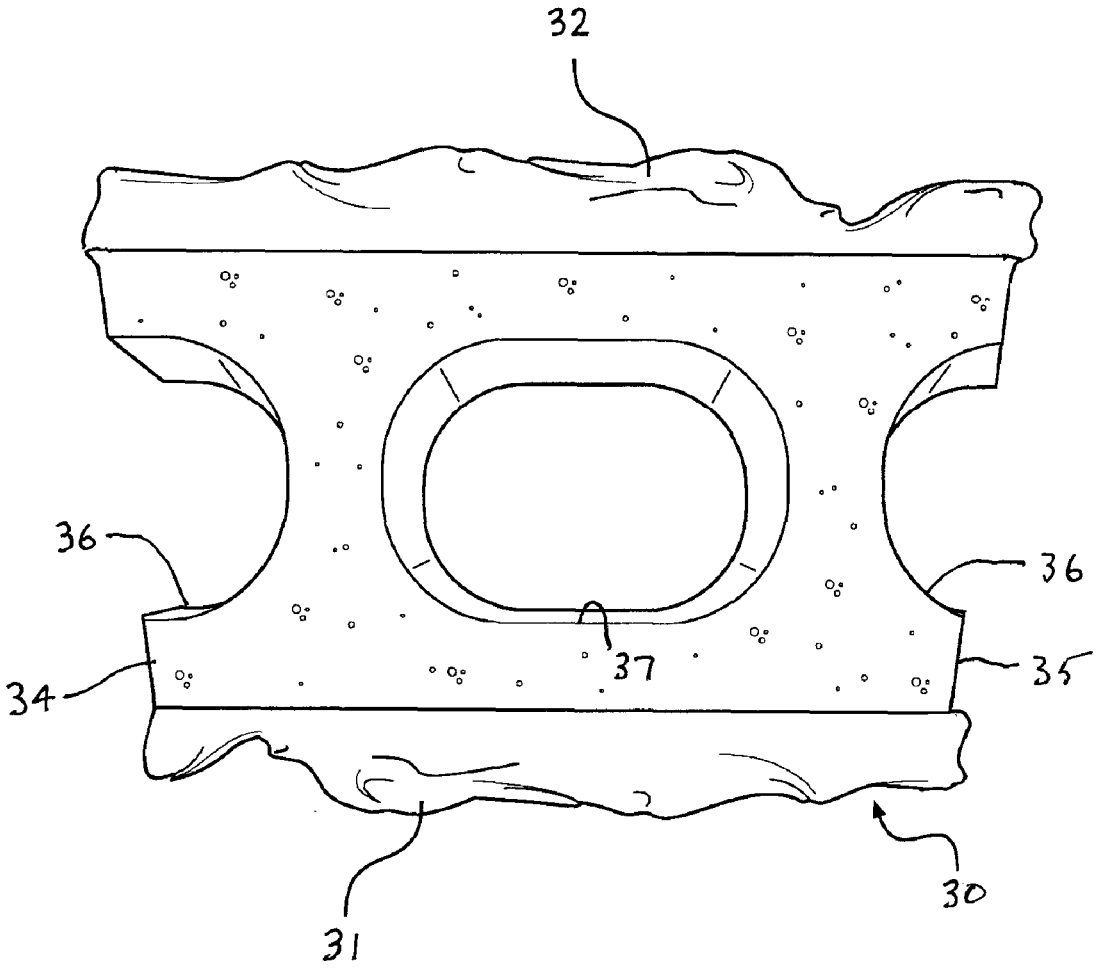
FIG. 2 is a top plan view of an exemplary block cast in a form and according to the process of the present invention.

FIG. 2 is a top view showing an example of a block 30 which can be made using the form and process of the invention. However, it should be understood that this is merely one example and that other block configurations also may be made using the invention. The illustrated block 30 has two spaced faces 31-32 which are highly textured. Each of the faces 31-32 may have the appearance of a single natural stone or may have the appearance of multiple natural stones with deep grooves formed between the simulated stones as would appear with natural stones are stacked. The block 30 has a substantially flat top 33 and a substantially parallel flat bottom (not shown) which allows the block 30 to be stacked with other blocks for forming a vertical wall. The block 30 also has two spaced sides 34 and 35. If a number of blocks 30 are to be used only for making straight walls, the sides 34 and 35 may be parallel to each other. However, if the sides 34 and 35 are tapered so that the width of the block face 31 is less than the width of the block face 32, blocks 30 may be used for constructing both straight and curved walls. For straight walls, adjacent blocks are reversed so that adjacent block faces 31 and 32 alternate. If two short block faces 31 abut and two long block faces 32 abut on adjacent blocks, the adjacent blocks will have an angle which will allow the wall to curve or bend. In the exemplary block 30, vertical semicircular grooves 36 extend the height of block sides 34 and 35 and a vertical center passage 37 extends the height of the block 30. The grooves 36 and the center passage 37 have sufficient relief to allow easy separation of the block 30 from the form in which it was cast. The grooves 36 and one or more center passages 37 are optional. When provided, they lighten the weight of the block 30 and also allow interconnecting the blocks in adjacent tiers of a wall for increasing the integrity of a wall formed from the blocks 30.

Figure 3:
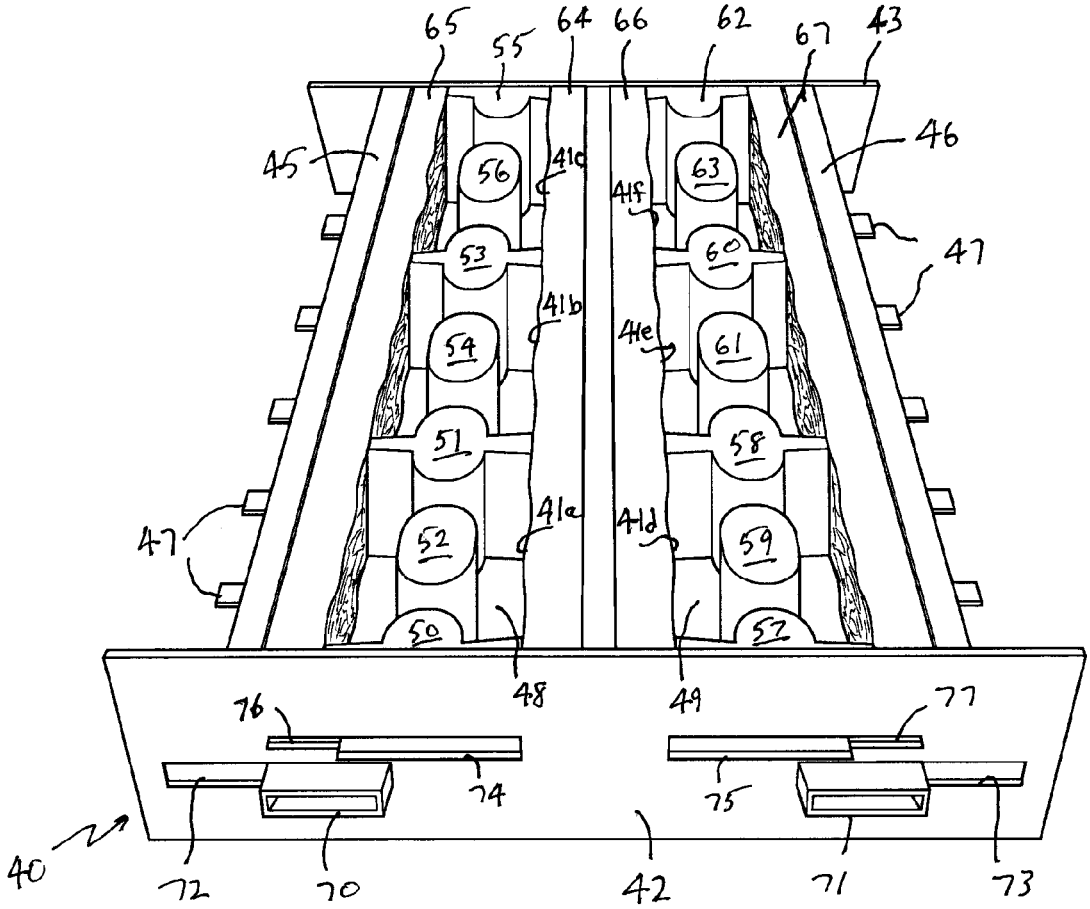
FIG. 3 is a perspective view as seen from the upper front of a form according to the present invention in an upright closed position.
Figure 4:
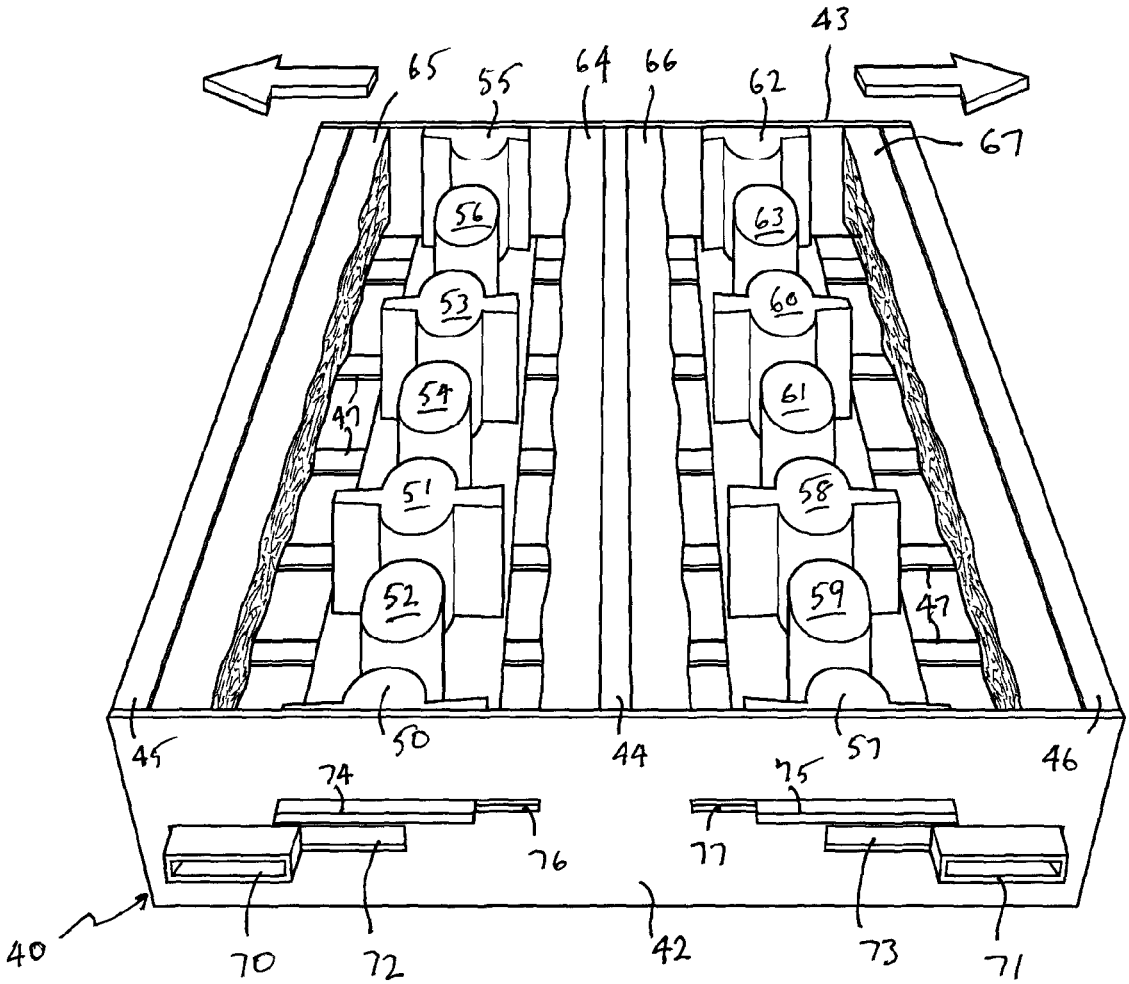
FIG. 4 is a perspective view as seen from the upper front of the form of FIG. 3 shown in an upright open position.

FIGS. 3 and 4 show a form 40 according to the invention. The form 40 has six cavities 41*a*-41*f* for simultaneously casting 6 of the blocks 30. It will be understood that the form may be modified for casting only one block or for simultaneously casting a desired number of the blocks 30. Further, the configurations of the cavities 41*a*-41*f* can be varied for providing a desired shape and size and surface texture to the cast blocks. As will be discussed below, the cavities 41*a*-41*f* include inserts and textured surfaces for shaping and texturing the cast blocks. The cavities 41*a*-41*c* extend in a row and the cavities 41*d*-41*f* extend in a row. The cavities 41*a*-41*f* may be configured to provide the same shape, surface design and texture to all of the blocks cast therein, or blocks cast in different cavities may have different shapes and surface designs. Further, blocks cast in two adjacent cavities may have different lengths.

The form 40 includes a rigid front plate 42, a rigid rear plate 43, a rigid center partition 44 which is secured to the front and rear plates 42-43, and two side plates 45 and 46 which are mounted on a plurality of parallel tubes, channels or members 47 for movement towards and away from opposite sides of the center partition 44. The parallel members 47 do not move relative to the center partition 44.

A rigid base 48 extends continuously along the bottoms of the three cavities 41*a*-41*c* and a separate rigid base 49 extends continuously along the bottoms of the three cavities 41*d*-41*f*. For the cavity 41*a*, spaced members 50 and 51 form the angled block sides 34 and 35 and a member 52 forms the vertical center passage through the block 30. For the cavity 41*b*, the member 51 and a member 53 form the angled block sides 34 and 35 and a member 54 forms the vertical center passage 37 through the block 30. For the cavity 41*c*, the member 53 and a member 55 form the angled block sides 34 and 35 and a member 56 forms the vertical center passage 37 through the block 30. The members 50-56 are secured to the rigid base 48. For the cavity 41*d*, spaced members 57 and 58 form the angled block sides 34 and 35 and a member 59 forms the vertical center passage through the block 30. For the cavity 41*e*, the member 58 and a member 60 form the angled block sides 34 and 35 and a member 61 forms the vertical center passage 37 through the block 30. For the cavity 41*f*, the member 60 and a member 62 form the angled block sides 34 and 35 and a member 63 forms the vertical center passage 37 through the block 30. The members 57-62 are secured to the rigid base 49. The members 50-62 may be formed from a rigid material or from a resilient material.

A resilient insert 64 is mounted on one side of the center partition 44. The insert 64 is shaped to impart a desired design to one face of blocks cast in the cavities 41*a*-41*c*. The opposite faces of blocks cast in the cavities 41*a*-41*c* are formed by a resilient insert 65 which is secured to the side plate 45 and a resilient insert 66 which is attached to the side plate 45. The resilient inserts 64-67 may be textured, for example, to simulate the appearance of one or more stones on the face of a cast concrete block with deep crevices separating the simulated stones. Further, prior to casting concrete blocks in the form 40, an optional dye may be applied to the shaped surfaces of the inserts 64-67 to impart the coloration of natural stones to the cast blocks. Alternately, coloring may be added to the concrete prior to casting the blocks.

According to the invention, two parallel channels 70-71 are mounted in spaced, aligned slots 72-73 in the front plate 42, respectively, and in corresponding slots (not shown) in the rear plate 43. The channels are sized to receive tines (not shown) on a forklift (not shown). The slots 72-73 are wider than the width of the channels so that the channels 70-71 may be moved between the positions shown in FIG. 3 to the positions shown in FIG. 4 where the channels 70-71 are spaced further apart. Similarly, ends 74 and 75, respectively, of the cavity bases 48 and 49 are mounted for limited movement in slots 76 and 77. The cavity bases 48 and 49 can move between the positions shown in FIG. 3 to the positions shown in FIG. 4 where they are spaced further apart. The form side place 45 is attached to the channel 70 so that when the channel 70 is moved to the position shown in FIG. 4, the side plate 45 and attached insert 65 are spaced further from the center partition 44 and the attached insert 64. Similarly, the form side plate 46 is attached to the channel 71 so that when the channel 71 is moved to the position of FIG. 4, the side plate 46 and the attached insert 67 are spaced further from the center partition 44 and the attached insert 66. The channels 70-71 are moved to the positions shown in FIG. 4 by engaging the channels 70-71 with tines on a forklift and operating the forklift to move the tines apart. As the channels 70-71 are moved to the FIG. 4 position, the bases 48 and 49 are simultaneously moved to the FIG. 4 positions where they are spaced further from the inserts 64 and 66, respectively. Moving the channels 70-71 to the FIG. 4 positions provides sufficient clearances between blocks cast in the cavities 41*a*-41*c* and the inserts 64 and 65 to allow cast blocks to be removed from the cavities, and allows sufficient clearances between blocks cast in the cavities 41*d*-41*f* and the inserts 66 and 67 to allow cast blocks to be removed from the cavities.

Concrete blocks are cast using the form 40 according to the following process:

a) the form 40 is moved to a pouring location either using a forklift or a conveyor and the cavities 41*a*-41*f* are filled with concrete;

b) the form 40 may be left at the pouring location or it may be moved on a conveyor or with a forklift to a location while the poured concrete blocks sufficiently cure to permit removal of the blocks from the form 40; and c) the blocks are then removed from the form 40 by inverting the form 40, positioning the form on a support surface, moving the channels 70-71 apart to open the form 40, and then lifting the form 40, leaving the blocks on the support surface.

The support surface on which the blocks are deposited may be, for example, a conveyor or a pallet or a layer of blocks which were previously deposited on a pallet. Alternately, the cured blocks could be stacked on the bed of a delivery vehicle.

The process has been described as using a forklift for moving the form after the blocks are cast and for inverting the form, positioning the form on a support surface, opening the form and for lifting the form to leave the blocks on the support surface. It should be appreciated that this can be performed by one or more dedicated machines which move, invert and open the form. Further, a number of the forms may be stacked while the cast blocks cure, either using a forklift or another machine It will be appreciated that various modifications and changes may be made to the above described preferred embodiment of a form and process for casting concrete blocks without departing from the scope of the following claims.

The invention claimed is:

1. A method for casting at least one concrete block having at least one textured surface comprising the steps of:

a) providing a form having at least one mold cavity defined in part by a first side which is movable laterally relative to a second side, and wherein a mold insert is mounted on the first side for imparting a texture on a side of a cast block, the form further having two laterally spaced generally parallel channels with at least one of the channels movable laterally relative to the other channel, and wherein said first side is moveable with said first channel;

b) casting a concrete block in the mold cavity in the form;

c) engaging the channels with a machine;

d) after a cast block is at least partially cured, using the machine to lift and invert the form and to set the form and cast block on a support surface;

e) moving at least one of the channels laterally relative to the other channel to cause the first side to move away from the second side; and f) using the machine to lift the form away from the cast block, leaving the cast block on the support surface.

2. A method according to claim 1, and the form has at least two cavities for simultaneously casting at least two blocks, wherein each of said cavities is defined in part by a first side which is movable laterally relative to a second side, and wherein at least one mold insert is mounted on the first sides for imparting a texture on a side of blocks cast in said cavities.

3. A method according to claim 2, and wherein said first sides of said cavities are moved with said first channel.

4. A method according to claim 2, and wherein the first side of one cavity is moved with one of said channels and the first side of another cavity is moved with the other of said channels.

* * * * *